US006637520B1

(12) United States Patent
Purcell

(10) Patent No.: US 6,637,520 B1
(45) Date of Patent: Oct. 28, 2003

(54) COMPONENT MOUNTING METHOD AND APPARATUS FOR A PERCUSSION TOOL

(75) Inventor: Joseph M. Purcell, Shannon (IE)

(73) Assignee: Azuko Pty Ltd, ACN (AU)

( * ) Notice: Subject to any disclaimer, the term of this patent is extended or adjusted under 35 U.S.C. 154(b) by 0 days.

(21) Appl. No.: 09/720,211

(22) PCT Filed: Jun. 10, 1999

(86) PCT No.: PCT/AU99/00451

§ 371 (c)(1),
(2), (4) Date: Mar. 21, 2001

(87) PCT Pub. No.: WO99/67065

PCT Pub. Date: Dec. 29, 1999

(30) Foreign Application Priority Data

Jun. 22, 1998 (AU) ..... PP4263

(51) Int. Cl.[7] ..... B25D 11/00

(52) U.S. Cl. ..... 173/91; 173/210; 173/1; 175/19; 175/57

(58) Field of Search ..... 173/90, 91, 210, 173/211, 1; 175/19, 56, 57, 300, 414

(56) References Cited

U.S. PATENT DOCUMENTS

| | | | | | |
|---|---|---|---|---|---|
| 3,606,930 | A | * | 9/1971 | Curington | 173/73 |
| 4,384,626 | A | * | 5/1983 | Derouin | 175/57 |
| 5,085,284 | A | * | 2/1992 | Fu | 175/296 |
| 5,141,062 | A | * | 8/1992 | Anderson | 175/234 |
| 5,325,926 | A | * | 7/1994 | Lay et al. | 166/380 |
| 5,562,170 | A | * | 10/1996 | Wolfer et al. | 175/296 |
| 5,711,205 | A | * | 1/1998 | Wolfer et al. | 92/155 |
| 5,954,146 | A | * | 9/1999 | McLeod et al. | 175/257 |
| 6,062,324 | A | * | 5/2000 | Hipp | 175/296 |
| 6,070,678 | A | * | 6/2000 | Pascale | 175/300 |
| 6,170,581 | B1 | * | 1/2001 | Lay | 175/296 |
| 6,237,704 | B1 | * | 5/2001 | Lay | 175/296 |

FOREIGN PATENT DOCUMENTS

| | | |
|---|---|---|
| DE | 29703683 A | 6/1998 |
| EP | 265380 A | 4/1988 |

* cited by examiner

*Primary Examiner*—Rinaldi I. Rada
*Assistant Examiner*—Louis Tran
(74) *Attorney, Agent, or Firm*—Gifford, Krass, Groh, Sprinkle, Anderson & Citkowski, P.C.

(57) ABSTRACT

There is provided a hammer assembly (10) comprising a hammer casing (11) having a bore (12) therethrough and a drive sub (13) and retainer (15) supporting a drill bit (14). A piston (16) has a hammer end (17) adapted to strike an anvil end (20) of the drill bit (14). A porting body (21) is located in the bore (12) by expandable mounting member (22) frictionally engaged with the bore (12) by a tapered portion of the porting body (21) being urged by a top sub (23) into a tapered bore in the mounting member (22). The porting body (21) supports a non-return valve (24) in a flushing fluid path communicating with the bit face. The mounting member (22) has a small annular flange (40) adapted to engage a shoulder (41) in the casing (11) and opposed axial slots (42) extending from port apertures (43) to the upper rim (44) of the mounting member (22). The porting body (21) comprises an annular manifold (45) for pressurized fluid supplied via top sub bore (46), non return valve chamber (47) and passages (50). A compressible spacer (52) is located on a shoulder (53) on the porting body (21) to be compressed by a corresponding shoulder (54) on the top sub (23), the progression of which is limited by a top sub flange (55) bearing on the end (56) of the casing (11).

20 Claims, 3 Drawing Sheets

COMPONENT MOUNTING METHOD AND APPARATUS FOR A PERCUSSION TOOL

This invention relates to a component mounting method and apparatus for a percussion tool.

This invention has particular application to a component mounting method and apparatus for mounting of porting bodies or the like in hammer drill casings for rock drilling and for illustrative purposes reference will be made to this application. However, it is to be understood that this invention could be used in other applications where location of componentry in other apparatus subject to shock or vibration is required, such as other hammer drills, jackhammers, riveting apparatus and the like.

In hammer drills and other tools a pressurized fluid is used to actuate a piston that oscillates to repetitively strike a working bit or other component. Such tools generally comprise a cylindrical working chamber for the piston. For the most part the chamber is formed in an elongate housing with components such as chucks, porting bodies and the like mounted coaxially with the chamber. The components generally require location at discrete axial positions in the housing.

During operation of the tool there is an extreme amount of vibration, which requires that the components be securely located against this vibration as well as against other axial loads. This has been achieved by many conventional means. For example, the housing may be provided with integrally machined shoulders, grooves to accept a circlip or the like, or threaded engagement with the bore.

Machined shoulders have the disadvantage that the shoulder necessarily results in reduction in the bore and thus the diameter of the piston that may be installed therethrough. This results in a reduction in piston working area, which reduction is greater in proportion than the linear reduction in diameter due to $r^2$ dependence of area. The percussive force applied by the piston is directly related to the cross-sectional area of the piston, thus the larger the shoulder the lower the percussive output of the tool.

In rock drills of the hammer type, the extreme vibration requires the use of a high compressive force retaining the component in engagement with the shoulder, the clamping force being provided by a threaded component which screws into the housing and clamps down on a compression ring which sits on top of the components to be clamped. The compression ring is needed because it is extremely difficult to manufacture all of the components to the required lengths so that they all clamp together simultaneously.

The torque that must be applied to the threaded component to locate the component against vibration effectively is outside the range of many rigs. As a result the clamping force is often not high enough to eliminate movement of the components. Due to the movement in operation of the components the faces that are clamped are subject to longitudinal wear. The degree of this wear is dependent on the cross-sectional area of the clamping faces. Generally the clamping face of least cross-section is the shoulder in the external cylinder which the assembly sits on. This must be large enough to allow for the wear due to component movement so that the degree of longitudinal wear is minimized. A side effect of increasing the shoulder size is it further restricts the diameter of the piston that can be placed in the assembly.

As a result of the foregoing, current shoulder mounting systems are generally compromises which allow longitudinal wear while maintaining a piston cross-section which provides a resulting percussive output. This system in operation has to be continually checked for wear and wear shims are inserted as the wear increases. The disadvantage of this is the porting or timing of the tool is effected due to the repositioning of the ports through this longitudinal wear.

With reference to the use of grooves in the housing wall to accept a circlip or the like for retention of components, it has been reported that the Ingersoll-Rand Quantum Leap hammer purports to overcome the inherent longitudinal wear of shoulder-dependent location and to offer increased piston diameter.

The disclosed apparatus locates a porting body and upper piston guide assembly by means of a circlip located in a groove formed in the inner wall of the housing. The assembly is clamped against the circlip by a top sub component in a conventional manner.

This arrangement has several inherent disadvantages. Firstly, the groove weakens the housing. Secondly, piston area is only obtained by minimization of the circlip protrusion area, which as has been observed will tend to increase longitudinal wear. Thirdly, in service the circlip is difficult to remove. Lastly, it appears that the reduction of longitudinal wear, if any, has been provided by the use of an intermediate bush compressed by application of relatively extreme torque to the top sub on installation. Many rigs do not deliver sufficient torque at installation to allow the top sub to compress the bush to the extent required to seat the top sub on its stop. When the top sub eventually closes up on its stop in use under operating torque and percussion, the assembly becomes difficult to disassemble.

Threaded engagement of a fully internal component such as a porting body with the bore has the inherent disadvantages of adding to the manufactured cost of the housing and in being substantially impossible to dismantle in the field without a specialized extraction tool.

The present invention aims to alleviate one or more of the above disadvantages and to provide a component mounting method and apparatus for a percussion tool which will be reliable and efficient in use.

With the foregoing and other objects in view, this invention in one aspect resides broadly in a method of mounting a component within a bore of a percussion tool including the steps of:

- inserting in said bore an expandable mounting member having an axial tapered recess;
- inserting into said recess a tapered spigot portion of the component;
- axially urging said spigot portion into said tapered recess to expand said mounting member into frictional engagement with said bore, and
- retaining said component in engagement with said mounting member.

The mounting member may be formed of any material dictated by the application to which it is to be put. The mounting member for a hammer drill may for example comprise a substantially annular resilient body of metal. The outer surface of the body may include a substantially cylindrical surface in its expanded attitude whereby the frictional engagement with the bore on expansion occurs over the substantially cylindrical surface.

The body may be formed of a resilient or deformable material, which may be expanded by stretching of the material itself. Alternatively, the body itself may be adapted to allow expansion whilst being formed of an essentially non-expandable material. For example, the body member may comprise a substantially annular body having one or more slots formed therein, whereby expansion of the body may be effected at the slot or slots. Alternatively, the mounting member may comprise a split collet comprising two or more collet portions. wherein the engagement of the mounting member with the bore may be achieved by expansion at the splits.

The mounting member may be located axially in the bore by the initial expansion of the mounting member body into initial engagement with the bore. However, in the case of hammer drills, it is preferred that the body and bore be provided with complementary axial location means. For example, the body may be provided with a locating portion adapted to engage a recess or shoulder provided in the bore on insertion of the mounting member. The locating portion may take any suitable form. For example, the mounting member may be provided with a relatively narrow engagement flange adapted to engage a corresponding recess or shoulder in the bore at a desired location for the mounting member.

Where a locating recess is used, the locating portion may be adapted to engage the recess on initial insertion of the component and expansion of the mounting member. Alternatively, the locating portion may be adapted to engage the recess on insertion into the bore and prior to insertion of the component. For example, the locating portion may be compressed against a bias of the body for insertion into the bore, whereupon the locating means may spring into engagement with the locating recess of the bore on attainment of the desired axial position.

Where the resilient bias of the body assists in attaining axial location of the mounting member in the bore, of course the recess may be associated with the body and the locating portion associated with the bore. However, in the interests of maintaining the maximum bore, the recess is preferably associated with the bore.

Where a locating shoulder is provided in the bore, this may be associated with a relieving recess in the bore to alleviate stress concentration.

Since the location means substantially locates the mounting member in a selected axial position in the bore, and does not to any significant degree contribute to the maintenance of the component in position against vibration loads in use, the location means may be minimally dimensioned. For example, in the case of location means comprising an annular recess in the bore, the annular recess may be substantially less deep than a retaining ring or circlip groove of certain prior art hammers. Accordingly, the annular groove may be selected as to dimension such that the wall thickness of the casing need not be greater than normal, without compromising the strength of the casing.

The mounting member may be adapted to mount any suitable component which may be configured with a tapered spigot and which requires retention in the bore of a percussion tool against vibratory loads. In the case of hammer drills, it is anticipated that the principle use of the method of the invention will be to locate and secure porting bodies and the like.

In such cases the taper of the recess in the mounting member may be selected to provide adequate engagement of the mounting member with the bore to secure the porting body or the like against vibratory loads in use, whilst providing for a reasonable clamping force and relative ease of disassembly in the field. In order to provide for the greatest binding force of the mounting member with the bore, a relatively small taper angle would be required. A small taper angle also reduces the clamping force that must be applied to the component to maintain the component in engagement with the mounting member. However, in order to permit ready disassembly of the apparatus in the field, a larger taper angle may be appropriate.

In the case of mounting porting bodies in hammer drills, it has been found that a taper angle of from 8° to 14° provides a useful compromise.

Mounting members for porting bodies or the like preferably form therewith a porting assembly, wherein the wall thickness of the mounting member does not detract significantly from the size or location of the ports in the porting body. For example, the mounting member may be provided with apertures adapted to register with corresponding apertures in the porting body to direct working fluid as an assembly.

In the case of mounting members of metal having expansion slots, the apertures are advantageously located at the end of the slot or slots, which has the added advantage of reducing the point stresses at the slot ends. The number of corresponding ports in the porting body will dictate the number of apertures. In a typical hammer drill, from 2 to 6 ports may be provided. The number of corresponding apertures may or may not be the same as the number of expansion slots, that is, additional corresponding apertures may be provided which are not associated with expansion slots.

The means for axially urging the spigot portion of the component into the tapered recess of the mounting member to expand the mounting member into frictional engagement with said bore may be by any means dictated by the application. For example, the mounting member may be supported in position in the bore and the component urged therein by a press. Retaining means may thereafter retain the component in its loaded position.

Alternatively, the means for axially urging the spigot portion of the component into the tapered recess and the means for retaining the component in engagement with the mounting member may comprise a compression assembly forming a part of the tool. For example, in the case of hammer drills, the component may comprise a porting body wherein the compression assembly includes the top sub or other component threaded to the casing.

The compression assembly may comprise for example a land on the component against which the top sub or other threaded component may bear. However, in order to provide for tolerance in axial fit of the top sub or threaded component and, in order to potentially reduce rotary displacement of the ports and apertures, it is preferred to use a compressible spacer as an intermediate component of the compression assembly.

In the preferred hammer drills, air or other gas or water or other liquids may provide the power. The porting body may be associated with any of the usual ancillary functions, such as non return valves, chip recovery fluid ports, piston engaging spigots therefor, reverse circulation tubes and the like.

In a further aspect, this invention resides in mounting apparatus for mounting a component within a bore of a percussion tool and including:

- a body portion having a substantially cylindrical outer surface adapted to pass into said bore and an axial tapered recess adapted to receive a tapered spigot of the component;
- a plurality of slots between said outer surface and said recess and extending axially to the open edge of said tapered recess, said slots allowing expansion of said body portion;
- compression means adapted to urge the tapered spigot of said component into said tapered recess and expand said body portion into engagement with said bore, and
- retaining means adapted to retain said component in said body portion.

In a further aspect, this invention resides in a hammer drill assembly of the type including a hammer casing, a bit and drive sub assembly, a piston, and a porting body adapted to control supply of a pressurized working fluid to a working surface of said piston to effect oscillatory impacts thereof on said bit, characterized in that said porting body includes an axial tapered spigot portion and is located within and secured to a bore of said casing by mounting means including a body portion having a substantially cylindrical outer surface adapted to pass into said bore and an axial tapered recess adapted to receive said tapered spigot, and a plurality of slots allowing expansion of said body portion, said porting body being urged into engagement with said mounting means by compression means adapted to urge the tapered spigot of said porting body into said tapered recess and expand said body portion into engagement with said bore, and retaining means adapted to retain said porting body in said body portion.

The hammer assembly may include a top sub which bears on the porting body and functions as compression and retaining means to both urge the porting body into engagement with the mounting means and retain the porting body in said body portion. Preferably, a compressible spacer such as a disc spring is interposed between the porting body and the top sub.

In order that this invention may be more readily understood and put into practical effect, reference will now be made to the accompanying drawings which illustrate a preferred embodiment of the invention and wherein.

Figure 1:
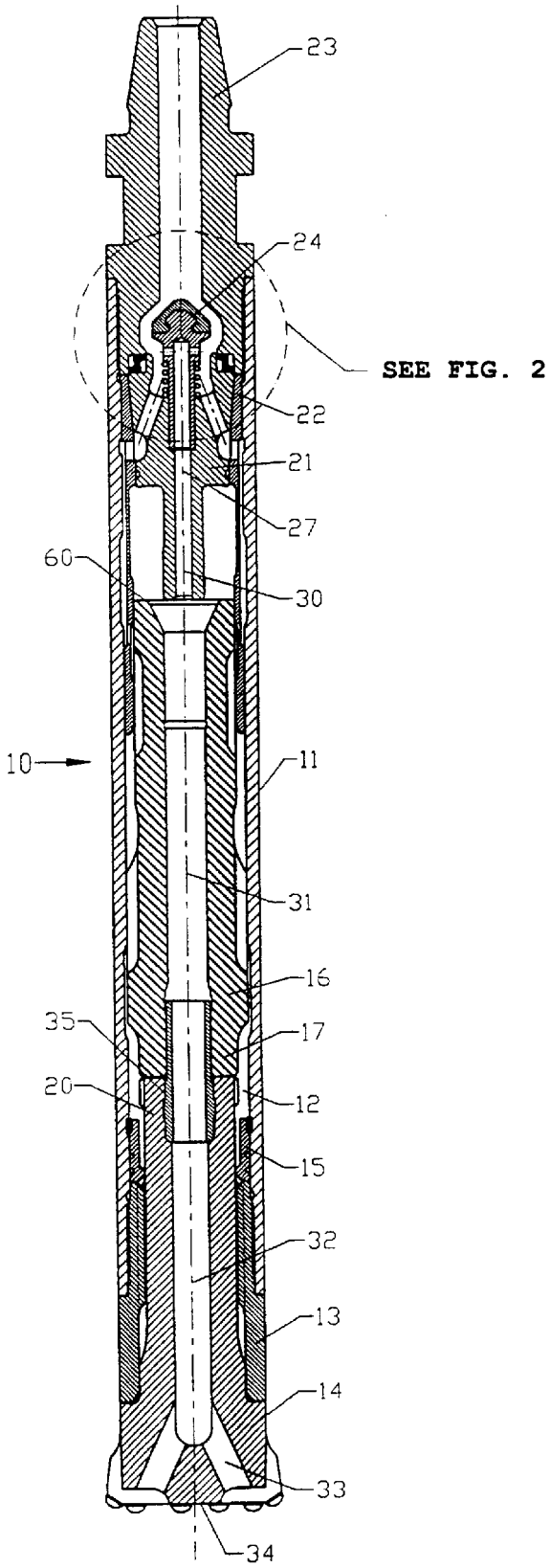
FIG. 1 is a longitudinal section through a hammer in accordance with the present invention.

In the figures there is provided a hammer assembly 10 comprising a hammer casing 11 having a bore 12 therethrough. A drive sub 13 is screwed to the lower end of the casing 11 and supports in splined relation a drill bit 14 which is retained therein by retainer 15.

A piston 16 is located in the bore 12 above the drill bit 14, a hammer end 17 of the piston 16 being adapted to strike an anvil end 20 of the drill bit 14. The piston 16 is able to reciprocate within the bore 12.

Figure 2:
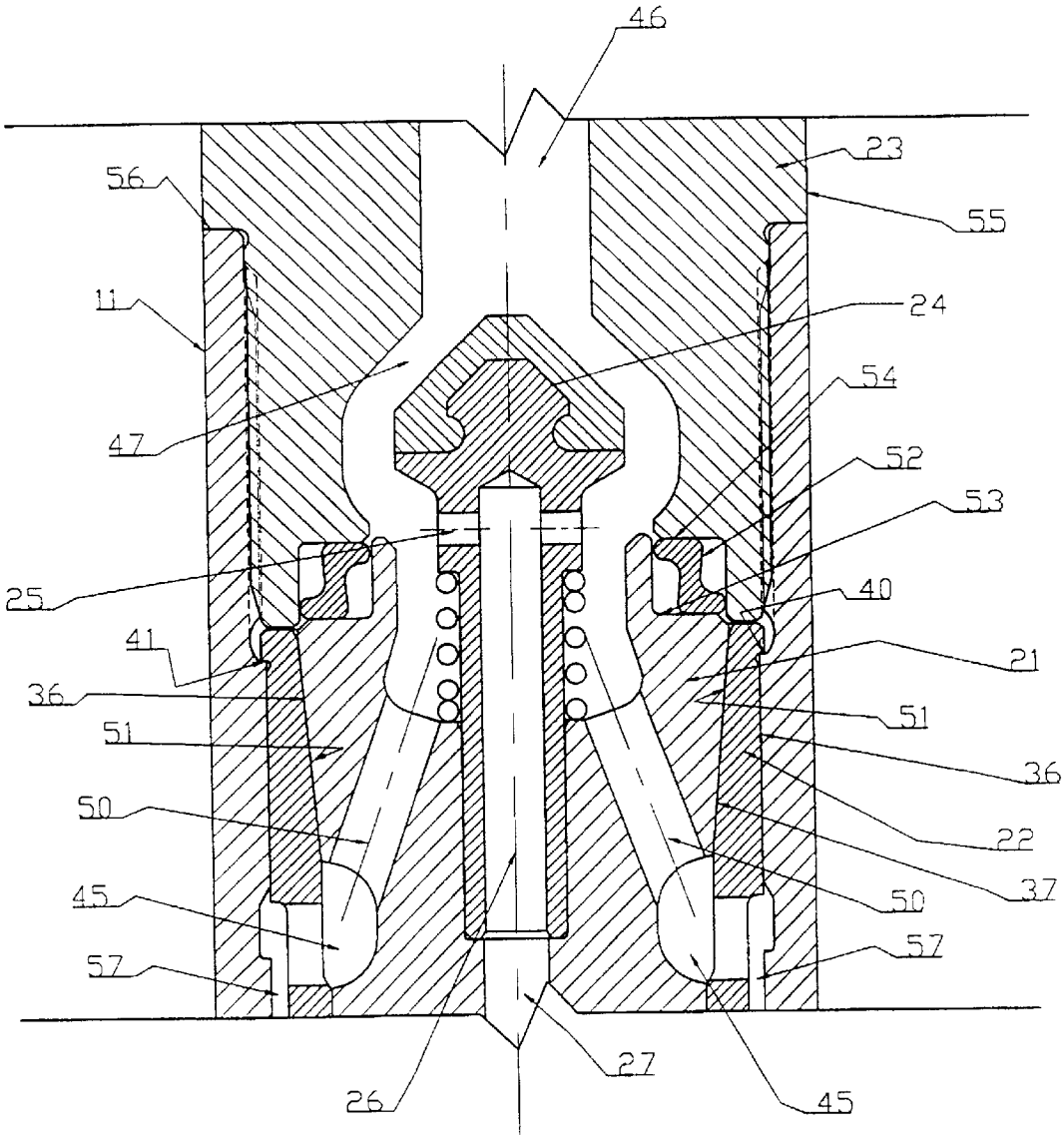
FIG. 2 is a detail view of a portion of the apparatus of FIG. 1.

A porting body 21 is located in the bore 12 by expandable mounting member 22 frictionally engaged with the bore 12. The frictional engagement is provided by cooperation between the porting body 21 and the mounting member 22, the porting body 21 being urged into the expandable mounting member 22 by a top sub 23 screwed into the upper end of the casing 11, the detail of which is best represented in FIG. 2. The porting body 21 supports a non-return valve 24 which also forms the start of a flushing fluid path comprising cross drilling 25, valve stem bore 26, porting body bore 27, body spigot bore 30, piston bore 31, drill bit shank bore 32 and passages 33 to the bit face 34. The flushing fluid path is made continuous between the shank bore 32 and piston bore 31 by sliding tube 35.

Figure 3:
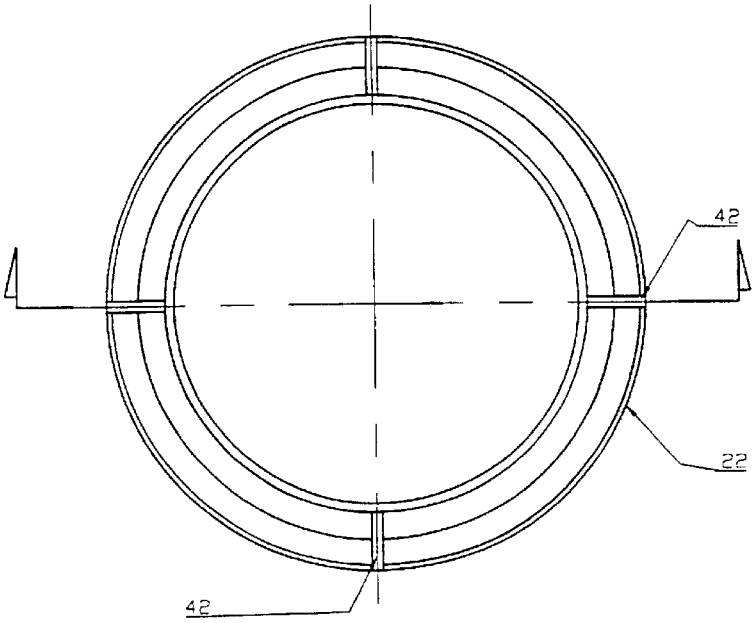
FIG. 3 is a plan view of a mounting member adapted for use in the apparatus of FIGS. 1 and 2.
Figure 4:
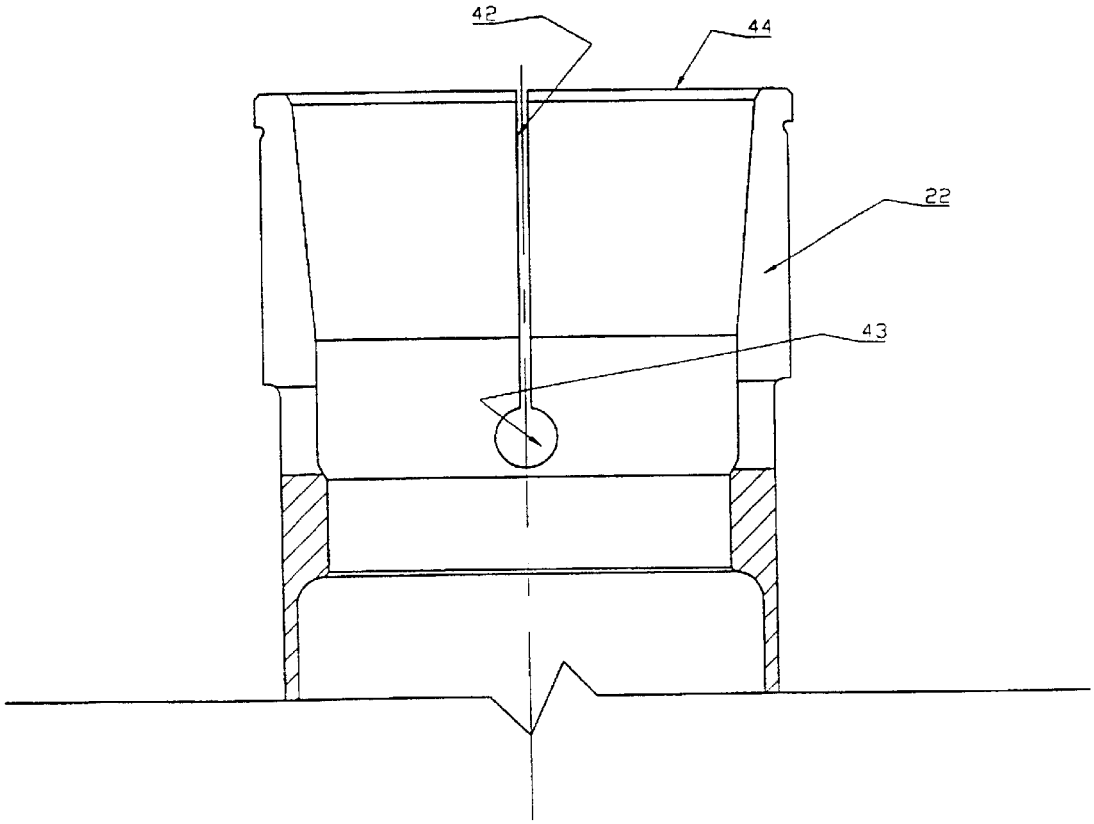
FIG. 4 is a section through the mounting member of FIG. 3.

Referring to FIGS. 2, 3 and 4, the mounting member 22 comprises a generally annular body having a substantially plain outer cylindrical surface and a tapered inner surface 37. The upper end of the mounting member 22 has a small annular flange 40 adapted to engage an annular recess shoulder 41 provided in the casing 11. The mounting member 22 has two pairs of opposed axial slots 42 extending from port apertures 43 to the upper rim 44 of the mounting member 22.

The porting body 21 comprises an annular manifold 45 in fluid communication with a pressurized fluid supply delivered via top sub bore 46, non return valve chamber 47 and passages 50. The porting body has a tapered spigot surface adapted to cooperate with the tapered inner surface 37 of the mounting member 22. A compressible spacer 52 is located on an annular shoulder 53 formed on the porting body 21 and is adapted to be compressed between the shoulder 53 and a corresponding shoulder 54 provided on the top sub 23 when the latter is screwed into the casing 11, the progression of which is limited by a top sub flange 55 bearing on the end 56 of the casing 11.

The compressible spacer 52 in use pushes the respective tapers 37, 51 into engagement, expanding the mounting member 22 into frictional engagement with the bore 12 of the casing 11, the axial location of the mounting member 22 being maintained until lock-up by engagement of the annular recess shoulder 41 by the annular flange 40. When installed, the manifold 45 cooperates with the apertures 43 to provide a conduit for working fluid to pass from the fluid supply in the valve chamber 47 to the annulus at 57 and thence to the piston working face 60. The apertures 43 also provide for stress relief at the lower ends of the slots 42.

Apparatus in accordance with the foregoing embodiment clamps the components in a manner whereby movement is eliminated at moderate top sub torque and also allows for a maximum piston cross-section to maximise percussive output.

It will of course be realised that while the above has been given by way of illustrative example of this invention, all such and other modifications and variations thereto as would be apparent to persons skilled in the art are deemed to fall within the broad scope and ambit of this invention as defined in the claims appended hereto.

What is claimed is:

1. A method of mounting a component within a bore of a percussion tool including the steps of:

inserting in said bore an expandable mounting member having an axial tapered recess;

inserting into said recess a tapered spigot portion of the component;

axially urging said spigot portion into said tapered recess to expand said mounting member into frictional engagement with said bore, and retaining said component in engagement with said mounting member.

2. A method of mounting a component according to claim 1, wherein said expandable mounting member comprises a substantially annular metal body having a substantially cylindrical surface in its expanded attitude whereby the frictional engagement with the bore on expansion occurs over said substantially cylindrical surface.

3. A method of mounting a component according to claim 2, wherein said expandable mounting member is expandable by means selected from one or both of deformation of the mounting member and expansion slots provided in the mounting member.

4. A method of mounting a component according to claim 2, wherein said expandable mounting member comprises a split collet comprising two or more collet portions, wherein said expansion is accommodated between said collet portions in use.

5. A method of mounting a component according to claim 1, wherein said mounting member is located axially in the bore by complementary axial location means provided on said body and bore.

6. A method of mounting a component according to claim 1, wherein said complementary axial location means comprises a substantially annular shoulder or flange on said body adapted to engage a substantially annular shoulder or recess respectively in said bore.

7. A method of mounting a component according to claim 1, wherein said complementary axial location means impinge minimally on the dimensions of the bore and casing wall thickness respectively and do not to any significant degree contribute to location of the component in position against vibration loads in use.

8. A method of mounting a component according to claim 1, wherein said component is a hammer drill porting body.

9. A method of mounting a component according to claim 8, wherein the taper of the recess in the mounting member is selected to provide adequate engagement of the mounting member with the bore to secure the porting body or the like against vibratory loads in use, whilst providing for a reasonable clamping force and relative ease of disassembly in the field.

10. A method of mounting a component according to claim 9, wherein the taper angle is selected to be in the range from 8° to 14°

11. A method of mounting a component according to claim 10, wherein the mounting member and porting body form a porting assembly.

12. A method of mounting a component according to claim 11, wherein the mounting member is provided with apertures adapted to register with corresponding apertures in the porting body to direct working fluid as an assembly.

13. A method of mounting a component according to claim 12, wherein the mounting member is provided with an expansion slot or slots, said apertures being located at the end of one or more of the slot or slots.

14. A method of mounting a component according to claim 1, wherein the means for axially urging the spigot portion of the component into the tapered recess of the mounting member to expand the mounting member into frictional engagement with said bore comprises a compression assembly forming a part of the tool.

15. A method of mounting a component according to claim 14, wherein said compression assembly includes the top sub or other component threaded to the casing.

16. A method of mounting a component according to claim 15, wherein the compression assembly includes a compressible spacer interposed between the top sub and the component.

17. Mounting apparatus for mounting a component within a bore of a percussion tool and including:

a body portion having a substantially cylindrical outer surface adapted to pass into said bore and an axial tapered recess adapted to receive a tapered spigot of the component;

a plurality of slots between said substantially cylindrical outer surface and said recess and extending axially to an open edge of said tapered recess, said slots allowing expansion of said body portion;

a compression member acting on said component to urge the tapered spigot of said component into said tapered recess and expand said body portion into engagement with said bore, and a retaining member securing said component in said body portion.

18. A hammer drill assembly of the type including a hammer casing, a bit and drive sub assembly, a piston, and a porting body adapted to control supply of a pressurized working fluid to a working surface of said piston to effect oscillatory impacts thereof on said bit, characterized in that said porting body includes an axial tapered spigot portion and is located within and secured to a bore of said casing by mounting means including a body portion having a substantially cylindrical outer surface adapted to pass into said bore and an axial tapered recess adapted to receive said tapered spigot, and a plurality of slots allowing expansion of said body portion, said porting body being urged into engagement with said mounting means by compression means acting on said porting body to urge the tapered sigpot of said porting body into said tapered recess and expand said body portion into engagement with said bore, and retaining means retaining said porting body in said portion.

19. A hammer drill assembly according to claim 18, wherein the compression and retaining means are provided by a top sub threaded into said hammer casing.

20. A hammer drill assembly according to claim 19, wherein said top sub acts on said porting body via a compressible spacer interposed between said top sub and said porting body.

* * * * *